United States Patent [19]

Bisson et al.

[11] Patent Number: 4,917,030

[45] Date of Patent: Apr. 17, 1990

[54] MACHINE FOR SUPPLYING AND SEWING OVERLAPPED FABRIC LAYERS

[75] Inventors: Flavio Bisson, Cava Manara; Lorenzo Buratti, Arquata Scrivia; Emilia Trento, Turin, all of Italy; André Delgrange, Tourcoing; Salah Maouche, Sainghin en Melantois, both of France

[73] Assignee: NECCHI Societa per Azioni, Pavia, Italy

[21] Appl. No.: 360,123

[22] Filed: Jun. 1, 1989

[30] Foreign Application Priority Data

Jun. 7, 1988 [IT] Italy ..... 42905 A/88

[51] Int. Cl.[4] ..... D05B 21/00

[52] U.S. Cl. ..... 112/121.12; 112/320

[58] Field of Search ..... 112/121.12, 121.15, 112/121.29, 102, 103, 308, 309, 113, 311, 320

[56] References Cited

U.S. PATENT DOCUMENTS

| | | | |
|---|---|---|---|
| 4,425,858 | 1/1984 | Hargett | 112/121.12 |
| 4,498,404 | 2/1985 | Sadeh | 112/121.12 |
| 4,688,499 | 8/1987 | Moore et al. | 112/121.12 |
| 4,748,920 | 6/1988 | Stutznacker | 112/121.12 X |
| 4,841,887 | 6/1989 | Castillo | 112/121.12 |

*Primary Examiner*—Peter Nerbun

*Attorney, Agent, or Firm*—Stevens, Davis, Miller & Mosher

[57] ABSTRACT

A machine which draws one by one a certain number of fabric layers, overlaps them and sews them in a completely automatic way, and which is composed of a stripping unit which draws the single fabric layers and disposes of them on a plane, a television camera and an electronic elaborator which determines the position of the fabric layers on the plane, a driving unit which, according to the determined position, draws and overlaps the fabric layers by means of an assembling device, and a sewing unit which receives the overlapped fabric layers from the assembling device and sews them together.

43 Claims, 9 Drawing Sheets

MACHINE FOR SUPPLYING AND SEWING OVERLAPPED FABRIC LAYERS

The present invention relates to a machine for supplying and sewing overlapped fabric layers.

Sewing units for the manufacturing sewing industry are known, which sew along a predetermined outline overlapped fabric layers, for example in the formation of shirt collars. The operation of such a unit is substantially as hereinafter defined. The operator draws from a tray, one by one, three fabric layers and overlaps them on a base provided with suitable reference edges. The base, with the three correctly overlapped and thereon arrested fabric layers moves toward a clamping group which draws the three fabric layers from the base itself. At this point a sewing head of a real sewing apparatus, forming a portion of the unit in question, sews together the three overlapped fabric layers along an open predetermined path moving along an appropriately shaped edge of the clamping group. After such a sewing of the three overlapped fabric layers, the base carries another series of overlapped fabric layers, arranged by the operator to the clamping group and drags with them by means of its lower surface the already sewn together fabric layers, which are then caused to fall into an appropriate space of the sewing unit.

From what has been described above the transfer of the three overlapped fabric layers under the sewing apparatus is automatic, while the drawing of the single fabric layers and their correct overlapping and disposition upon the supporting base is completely manual.

The necessity of manually overlapping fabric layers under the sewing head after drawing single fabric layers certainly represents a considerable limitation to the operation of such a sewing unit. It must be in fact remarked that such operations require a considerable cost for the activity of the operator beside the stress of the operator for such activity.

Moreover the sewing unit must always conform to the rhythm of the operator and not vice versa.

Thus it should be desirable to automate such an operation. Automation has not yet been proposed due to the difficulty of mechanically manipulating the fabric layers because of their lack of rigidity and their variability of typology.

It is therefore an object of the present invention to provide a machine for supplying and sewing overlapped fabric layers, wherein the above referred to manual operations are automatically executed. For obtaining such an object a machine for supplying and sewing overlapped fabric layers was developed, in which there are provided a sewing unit having a clamping group which is supplied with the overlapped fabric layers; and a seweing apparatus, disposed in correspondence with the clamping group, which sews the fabric layers. The machine is characterized by the fact that it comprises:

a stripping unit which provides holding means for the fabric layers and a supporting plane upon which the holding means release the fabric layers in a position separated one from another;

means mounted in correspondence with the supporting plane, which transform the visual image of the support plane and of the fabric layers, layed thereon, into the electrical signals;

electronic elaborating means connected to the means transforming the visual image into electrical signals for the determination of the position of the fabric layers on the support plane;

a driving unit connected to the electronic elaborating means, comprising an assembling device movable along the supporting plane and movable between the support plane and the sewing unit, the drive unit moving, according to the data supplied by the electronic elaborating means, the assembling device along said supporting plane for assembling one by one and for overlapping by means of the assembling device the fabric layers from the support plane, and for moving moreover the assembling device between the support plane and the sewing unit for discharging the fabric layers, picked up by the assembling device, on the sewing unit.

Other details and features of the invention will stand out from the description given below by way of non-limitative example and with reference to the accompanying drawings, in which.

Figure 1:
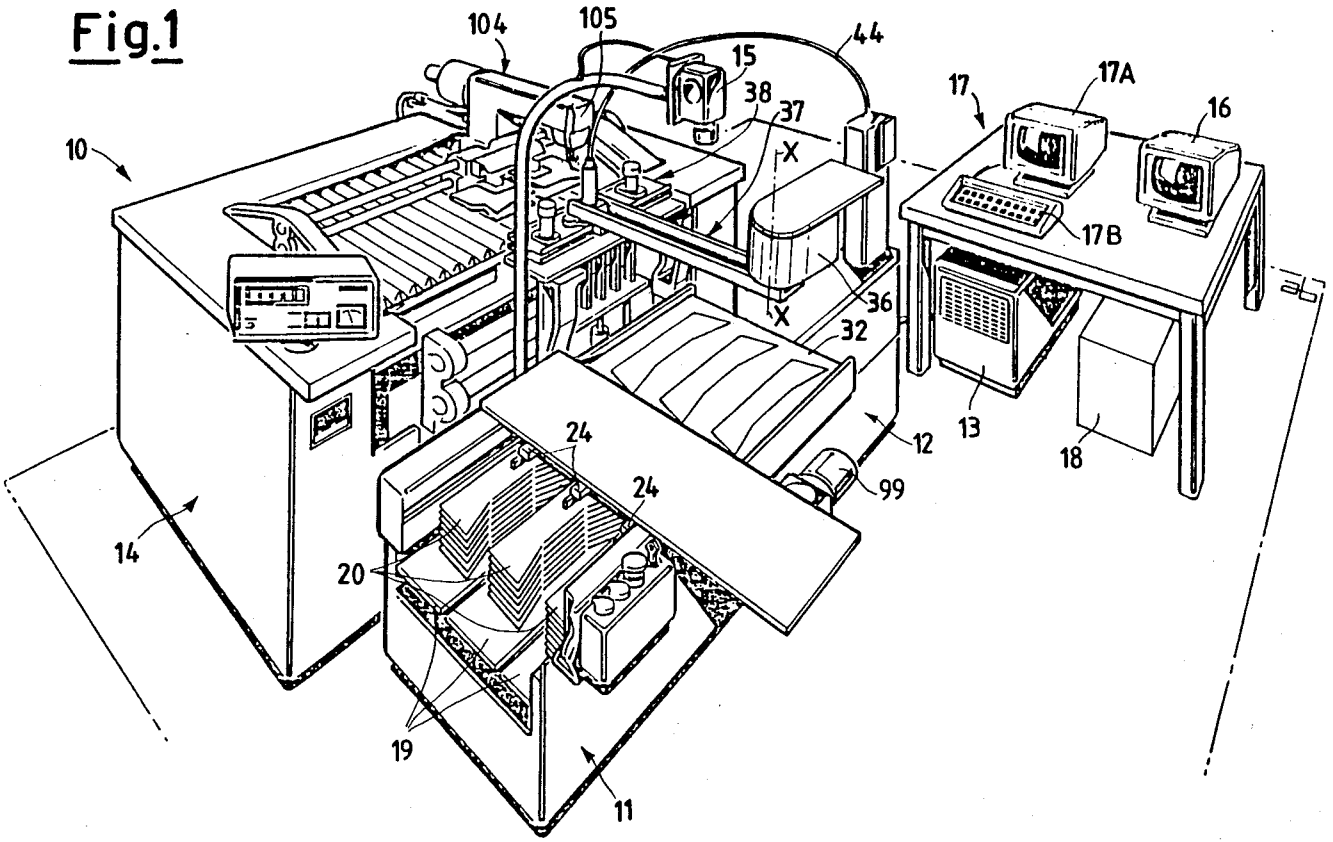
FIG. 1 shows in perspective view the machine according to the invention.

The machine 10, comprises a stripping unit 11, a driving unit 12, and correspondent control electronic unit 13, a sewing unit 14, a television camera 15, a relative monitor 16, an electronic elaborator 17 and a logic control unit 18.

Figure 2:
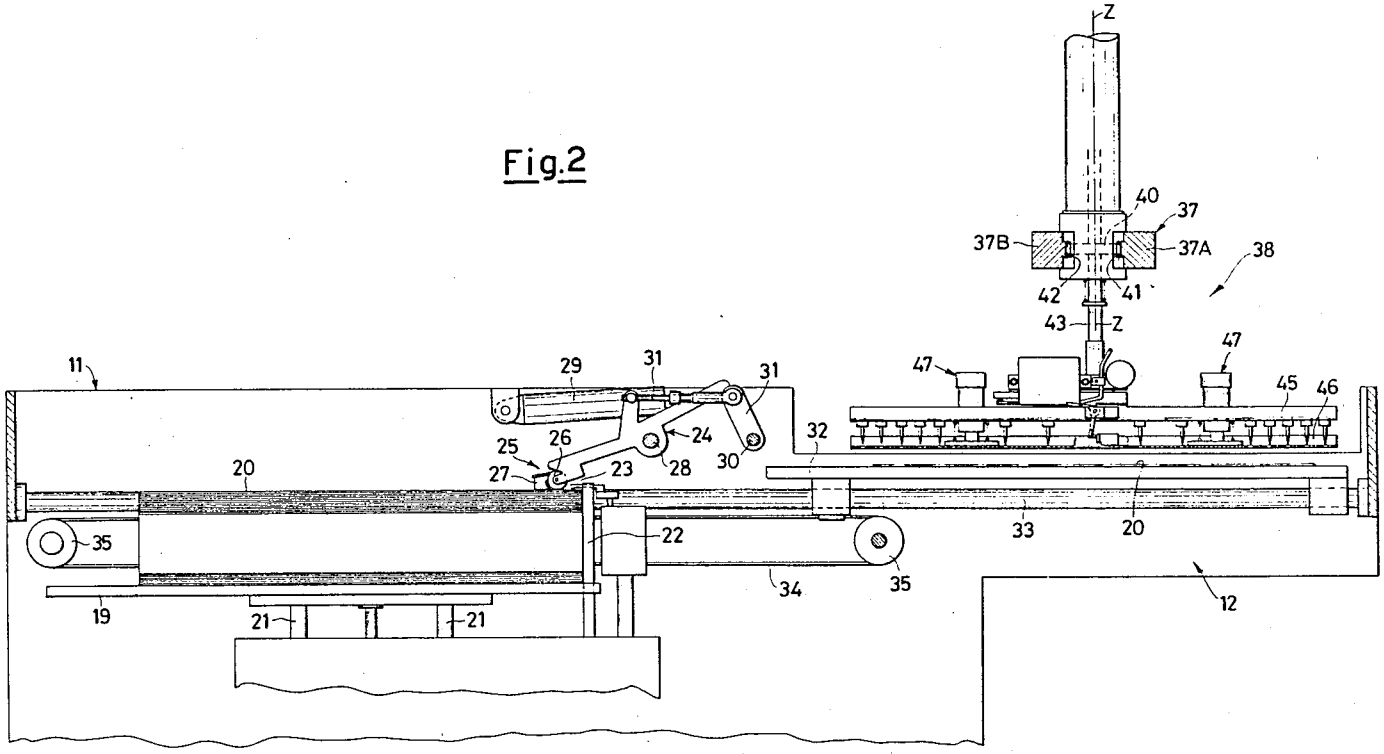
FIGS. 2, 3 are side views in section of a portion of the machine of FIG. 1, illustrating the operation of that portion.
Figure 3:
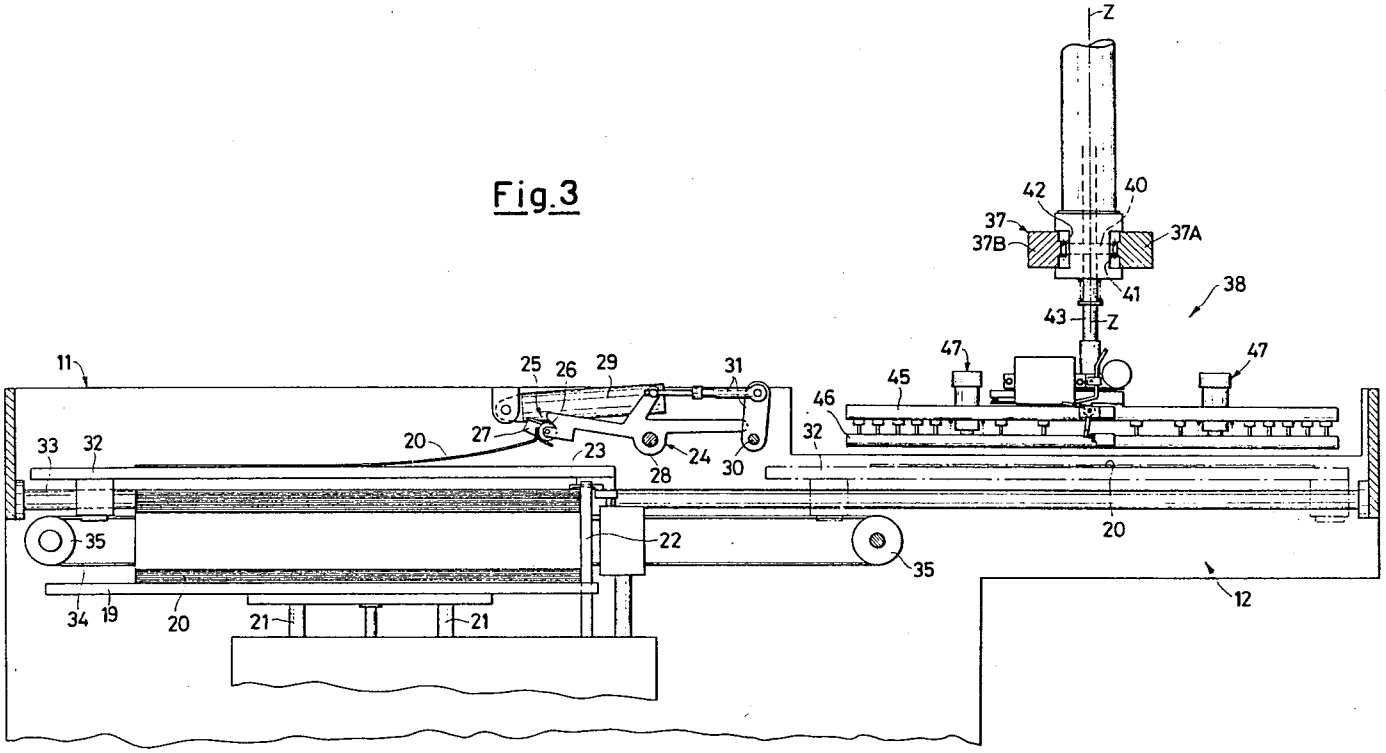

The stripping unit 11 comprises FIGS. 2, 3) three trays 19 on each of which a pile of fabric layer is placed.

Each tray 19 on its lower portion is supported by columns 21 and is raised and lowered through a hydraulic system not illustrated. Vertical rods are even provided, which rise from the edges of each tray 19 to define a containing area for the piles of fabric layers 20. In FIGS. 2, 3 there is illustrated only one column 22, corresponding to one of the trays 19, against which the pile of fabric layers 20 abuts. In this abutting area, overhanging each tray is mounted a mechanical stroke-end sensor, the sensible member of which is formed by a horizontal rod 23 designed to be touched and driven by the below pile of fabric layers 20 as it hereinafter is explained. Always in this abutting area, in correspondence with each tray 19 and overhanging the tray 19 is mounted a catching member 24 is of known type, designed to catch a single fabric layer 20. Each catching member 24 presents a catching head 25 formed by a small wheel 26, driven in rotation by a pneumatic actuator not shown, and by an opposed block 27. The catching members 24 are rotatably mounted on a common shaft 28 and are simultaneously driven in rotation around this shaft 28 by a pneumatic actuator 29 which acts through a shaft 30 on levers 31 connected to the catching members 24.

The stripping unit 11, moreover, comprises a supporting plane 32 slidably mounted on two parallel guide rods 33. The support plane 32 is horizontally translated along the guide rods 33 by an electric motor 99 (FIG. I) which acts on two parallel belts 34, of the closed-ring type, fixed to the supporting plane 32 and each of them wraps itself around a couple of toothed wheels 35, one of which (the right one in FIGS. 2, 3) is a driving one, that is, is driven by the cited electric motor 99. The support plane 32 translates between a loading position of the fabric layers 20 on the same plane, illustrated in FIG. 3, and an individualization and drawing position of the fabric layers 20 from the same plane, illustrated in FIG. 2.

The television camera 15 (FIG. I) is of the C C D matrix type and is directed on the support plane 32 in the individualization and drawing position, framing it completely. Substantially, the television camera 15 transforms the framed visual image, point by point into electric signals which are sent either to the monitor 16 for the visualization of the framed image, or to the electronic elaborator 17.

Figure 9:
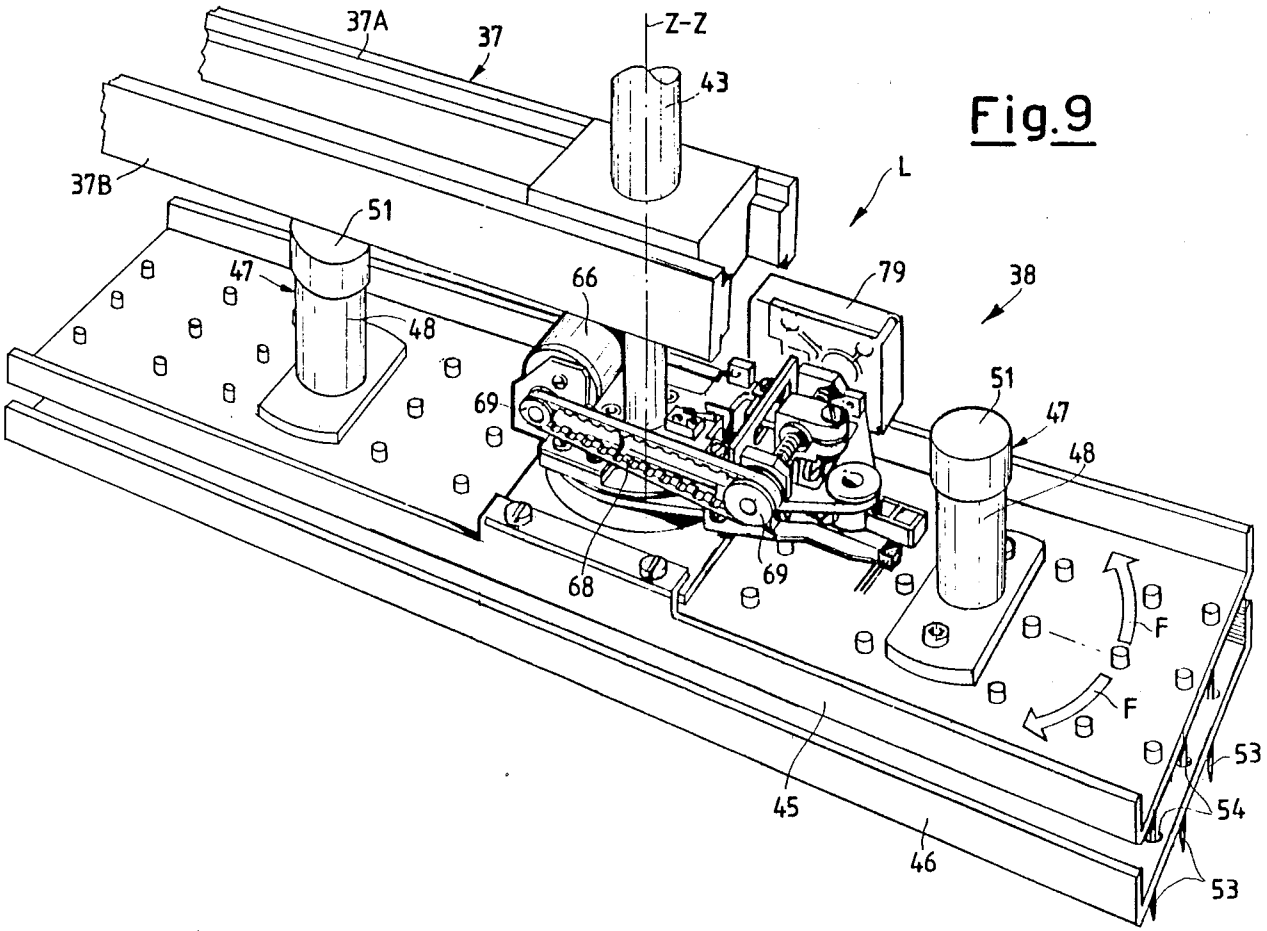
FIG. 9 is a perspective view of the portion of the machine of FIGS. 5, 6, and 7.

The electronic elaborator, which comprises a monitor 17 A and a keyboard 17 B, elaborates the visual image according to a scanning technique, for the reasons and in the way thereinafter described. The driving unit I2 comprises a fixed head 36 which carries an arm 37 which in turn carries at one end an assembling device 38. The arm 37 may accomplish two types of movements, i.e. a precise rotation around an X—X axis visible in FIG. 1, perpendicular to arm 37 and perpendicular to the support plane 32, and a rectilinear translation a long a y—y axis, visible in FIG. 4, which runs along the same arm and is perpendicular to the x—x axis. The assembling device 38 may in turn translate in rectilinear way along a Z—Z axis visible in the FIGS. 2, 3, 9 perpendicular to the support plane 32 and may even rotate around the Z—Z axis as it will be thereinfter seen. The arm 37 is formed by two semi-arms 37A and 37B which are kinematically connected through two toothed wheels 39 and 40, the first rotating around te X—X axis and the second around the Z—Z axis, engaging corresponding racks 41 and 42 of the two semi-arms 37A and 37B. The toothed wheel 40 is fixed to a shaft 43 carrying the assembling device 38. The kinematic elements of the driving unit are such as to cause even the rotation of the toothed wheel 39, moving the semi-arms 37A and 37B in opposite direction along the Y—Y axis, when a rotation around the X—X axis is given to the arm 37. This relative movement causes a corresponding rotation of the toothed wheel 40 and thus of the shaft 43 and of the assembling device, 38, both connected to said wheel 40, in such a way as to maintain the assembling device 38 always parallel to itself during the rotation of the arm 37 around the X—X axis. The shaft 43 is connected to a not shown cable inserted in a sheath 44 (FIG. 1), driven by an appropriate mechanism of the driving unit 12 in such a way as to move the shaft 43 along the Z—Z axis. Beside the assembling device 38, the remaining part of the driving unit 12 is known and at present it is to be found on the market and thus is not here described in detail. Referring to the FIGS. 9, 10, 11 and 12 the assembling device 38; comprises two principal elements formed by two parallel plates 45 and 46 connected to each other by two connecting members 47. Each connecting member comprises a bushing 48 in which a column, 49, provided with a foot 50 and a head 51, is mounted, free to slide. The bushing 48 is fixed on the plate 45, while the foot 50 is fixed to the plate 46. The connecting members 47 permit a relative approach and removal movement of the two plates 45 and 46 maintaining the parallelism between them. Around each bushing 48, between the two plates 45 and 46, a helicoidal spring 52 is mounted, which acts at one side on a surface of the plate 45 and at the other wide on the foot 50 so as to maintain the two plates 45 and 46 elastically spaced. The heads 51 and end-stroke elements and maintain the two plates 45 and 46 in a determinate position of greatest reciprocal distance against the action of the spring 52. On the plate 45 a plurality of needles 53 is fixed and, in correspondence with said needles 53, on the plate 46 an equal number of holes 54 are cut, through which the needles pass in determinated reciprocal positioning of the two plates 45 and 46. On a folded edge of the plate 45 there is mounted a bracket element 55 to which a hook 57 is pivoted at 56. The hook is L-shaped and has an arm 58 presented at its end with a locking tooth 59, and another arm 60 presented at its end with a counterweight 61. On a folded edge of the plate 46 there is fixed a L-shaped block 62 which present a notch 63 into which the locking tooth 59 is designed to sit.

For the rotation of the assembling device 38 around the Z—Z axis, the shaft 43 has at its end an anchorage foot 64 which couples, free to rotate, with a hollow element 65 fixed to the plate 45. An electric motor 66 is mounted on the foot 64 and transmits rotative motion to a screw 67 via a toothed belt 68 and two toothed wheels 69, one of the wheels is a driving wheel fixed to the motor shaft, while the other is a driven wheel fixed to the screw 67. The screw 67 is mounted, free to rotate, on two abutments 70 fixed to the foot 64. On the screw 67 there is mounted a block 71 which define a nut screw 72, coupled with the screw 67. The block 7I is provided with a tongue 9 which is placed, free to slide, in a slot 73 of an element 74 fixed to the foot 64. The free end of a flexible blade 76 is fixed to an extension 75 of the block 71, the other end of the flexible blade 76 is fixed to the hollow element 65. In ythis way, with one rotation of the screw 67, operated by the motor 66, there is a corresponding displacement of the block 71 along the axis of screw 67, guided by the slot 73. In turn the block 71 rotates the hollow element 65 though the blade 76. The fact that the junction 77 of the blade 76 to the extension 75 of the block 71 moves with rectilinear motion and the junction 78 of the blade 76 to the hollow element 65 which moves with circular motion is compensated by the flexibility of the blade 76 which will bend more or less according to the position of the junction 77 with respect to the rotational center of the junction 78. By an appropriate supply of the electric motor 66 it is possible to cause the rotation of the hollow element 65 relatively to the anchorage foot 64, that is to cause the rotation of the whole assembling device 38 around the Z—Z axis, along which the shaft 43 is placed, in one or in the other of the two rotational ways, indicated by the arrow F in FIG. 9.

The electric motor 66, the angular position sensor 79 and the two cited stroke-ends are connected to the command and control electronic unit 13.

Figures 4, 8:
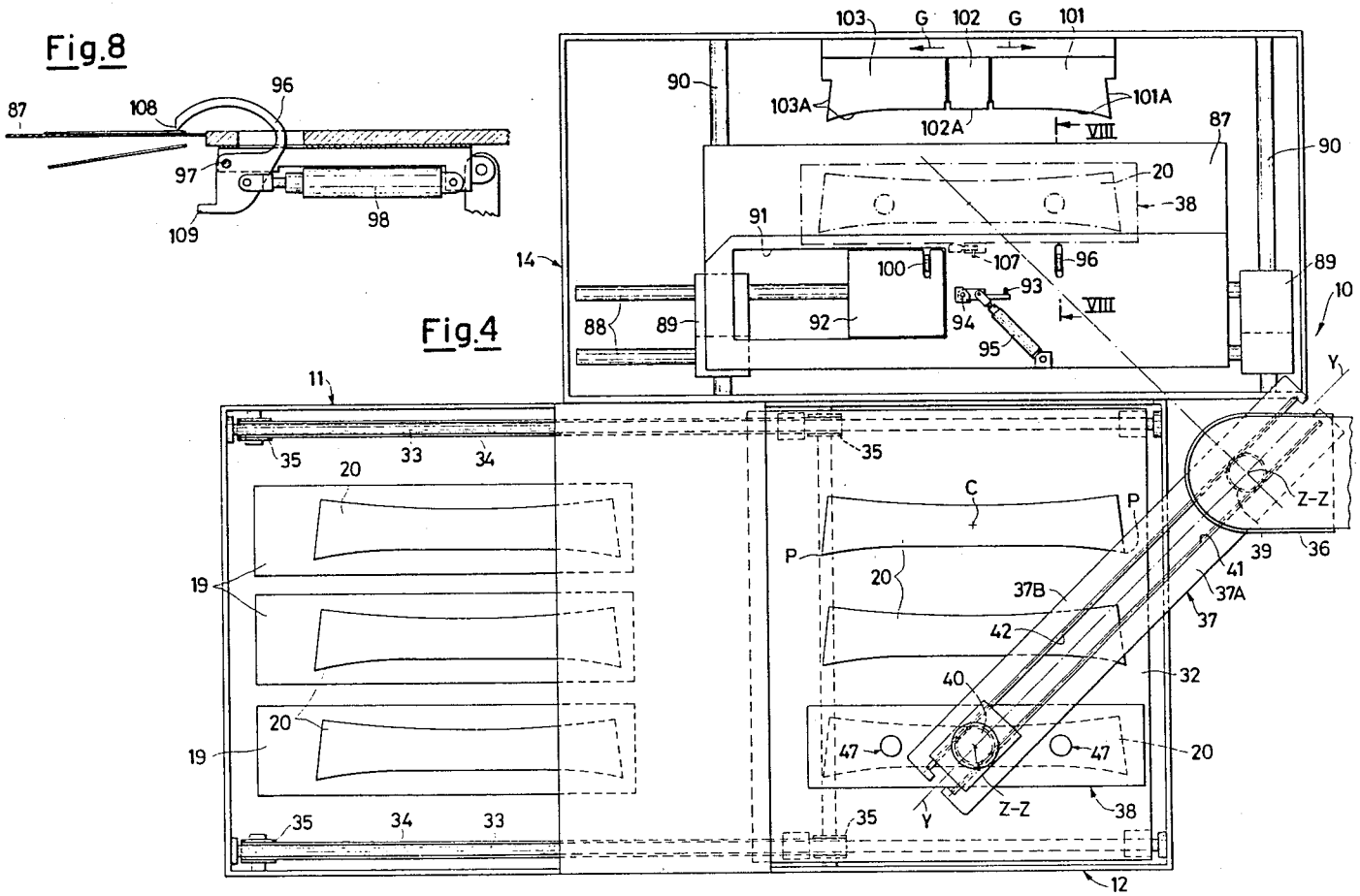
FIG. 4 is a plan view of the machine of FIG. 1, FIGS. 5, 6, 7, are partial side views of a portion of the machine of FIG. 1 which illustrate its operation.
FIG. 8 is a section along the lines VIII—VIII of FIG. 4 of another portion of the machine of FIG. 1.

With reference to the FIGS. 1, 4 and 8, the sewing unit 14 comprises a supporting base 87 mounted on rods 88 fixed on blocks 89 slidable along guide rods 90. The base 87 presents an aperture 91 in correspondence with which a slide 92 is provided, sliding along the aperture itself. On the base 87 there is mounted a small hammer 93 pivoted at 94 and driven in rotation by a pneumatic actuator 95. On the base 87 is even mounted a stop element 96 of the semi-ring type, well visible in FIG. 8, pivoted at 97 and driven in rotation by a pneumatic actuator 98. On the slide 92 a stop element 100 of the semi-ring type is mounted, identified to the semi-ring 96 and driven by a pneumatic actuator not illustrated. Opposite the base a clamping group of known type is provided, formed by three-pliers 101, 102, 103 kinematically connected to each other so as to move away and approach each other as is indicated by the arrow G. Each plier is formed, as known, by a lower holdfast and an upper one. In correspondence with the described clamping group a real sewing apparatus 104 with sewing head 105 is provided, of known type. The sewing apparatus 104 is movable with respect to the clamping group for executing a particular sewing, as will be seen thereinafter.

In succession the operating way of the machine 10 is described, with reference to a particular application, that is the production of shirt collars starting from three separated, substantially trapezium shaped fabric layers 20.

In the first place, upon each of the three trays 19 a pile of fabric layers 20 is placed having a trapezium shape. When the trays 19 are loaded, the real operative cycle of the machine 10 starts. The trays with the piles of fabric layers 20 are raised until the uppermost fabric layer contacts the small rods 23 of the mechanical stroke-end sensor, at which time the sensor causes the upward movement of the trays to stop. The three hold members 24 rotate at the command of the pneumatic actuator 29, until each small wheel 26 and the opposite block 27 come into contact with the uppermost fabric layer of each pile, as shown in FIG. 2 Through the corresponding pneumatic actuator 29, each small wheel 26 is driven in clock-wise direction (observing FIG. 2) until an edge of the fabric layer is clamped between the small wheel 26 and the opposite block 27 according to a known technique. Upon command of the pneumatic actuators 29, each of the catching members 24 rotates in the opposite direction to raise a single fabric layer over the support plane 32. At this point the support plane is translated by means of the electric motor 99 until the load position, as shown in FIGS. 3, is in such a way that the three said fabric layers 20 partially lean on the supporting plane 32. Upon command of the corresponding pneumatic actuators the three small wheels 26 are located in a counterclockwise direction so as to release on the support plane 32 the three fabric layers 20. The support plane 32 is then translated by the electric motor 99 into the individualizing and drawing position, as indicated in dotted lines in FIG. 3, under the television camera 15.

At this point the television camera 15 and the electronic elaborator 17 enter in working. The electronic elaborator 17, by means of graphic calculation computerized systems, calculates on the grounds of the electric signals coming from the television camera 15, and, for each fabric layer 20 the center C and the angle shut of an axis passing through two points P, forming the ends of two angles of the fabric layer 20 lying on the same side (FIG. 4). The calculation of the center C and the angle-shot are executed with reference to a couple predetermined reference of Cartesian axes lying on the support plane 32. The data of the three centers and of the three angle-shots of the three fabric layers 20 lying on the support plane 32 are sent, in appropriate form, to the command and control electronic unit 13. The monitor 17A and the keyboard 17B permit the operator to converse with the electronic elaborator 17, for example for receiving information about the calculated data, for receiving error signalling, etc. intervening where it is necessary. The monitor 16 serves simply to visualize the image framed by the television camera 15. The calculation program of the electronic elaborator 17 is not discussed in detail since it is within the reach of one skilled in the art.

The command and control electronic unit 13, on the basis of the position information of the three fabric layers 20 on the support plane 32, moves the arm 37 causing its rotation around the X—X axis and its translation along the Y—Y axis the arm 27 corners in sequence the assembling device 38 in correspondence with the three fabric layers 20. The assembling device 38 moves parallelly to itself and parallelly to one of the above cited Cartesian reference axes lying on the support plane 32. For each fabric layer 20 the center C is utilized by the command and control electronic unit 13 to carry in the assembling device 38 over the fabric layer 20 in such a way that the fabric layer 20 can be assembled on the surface of the same assembling device, as shown in FIG. 4; the knowledge of the angle-shot of the axis passing through the two points P is utilized by the command and control electronic unit to cause the rotation of the assembling device 38 with regards to the Z—Z axis, by acting on the electric motor 66 to carry it to above the cited angle-shot. When the assembling device 38 has reached the correct position over the fabric layer 20, the command and control electronic unit 13 commands the downwards sliding, along the Z—Z axis, of the shaft 43, that is, the descent of the assembling device 38 for the assembling of the fabric layer 20. With reference to the FIG. 4, the assembling sequence provides at first the assembling of the lowest fabric layer 20, shown in FIG. 4, then the assembling of the central one and finally the assembling of the highest layer.

Figure 5:
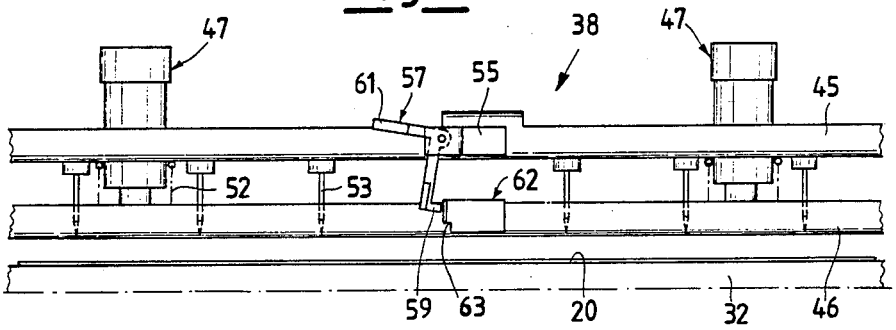
Figure 6:
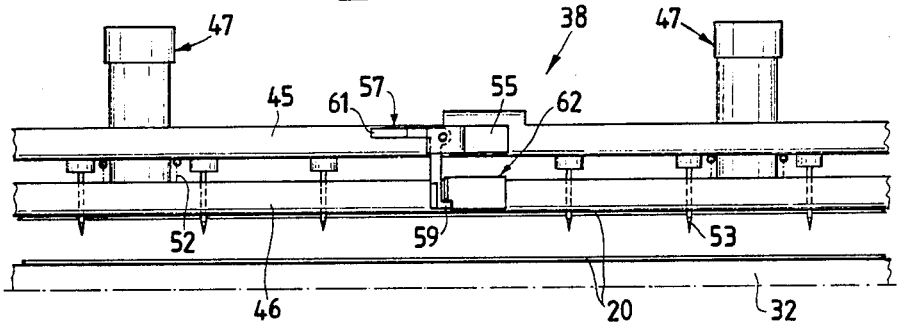
Figure 7:
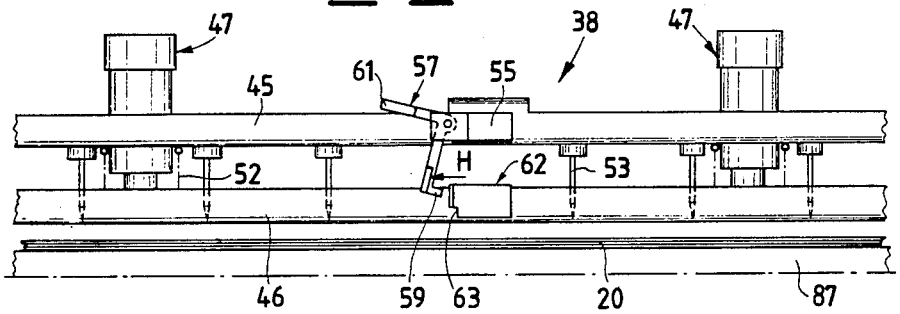

In FIGS. 5, 6 and 7 is shown the operation of the assembling device 38.

Figure 10:
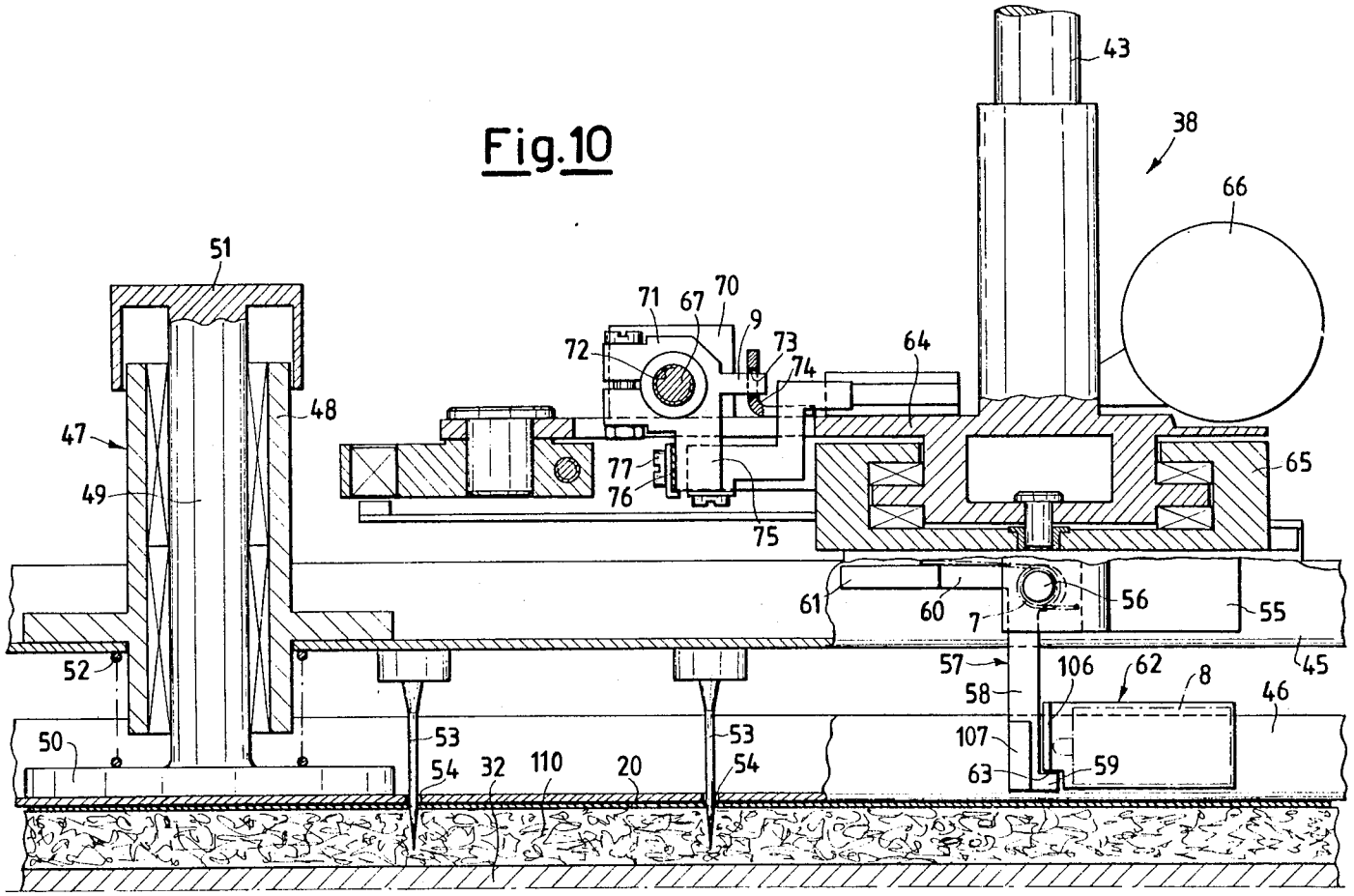
FIG. 10 is a partial side view along the arrow L, partially in section, of the machine of FIG. 9.
Figure 11:
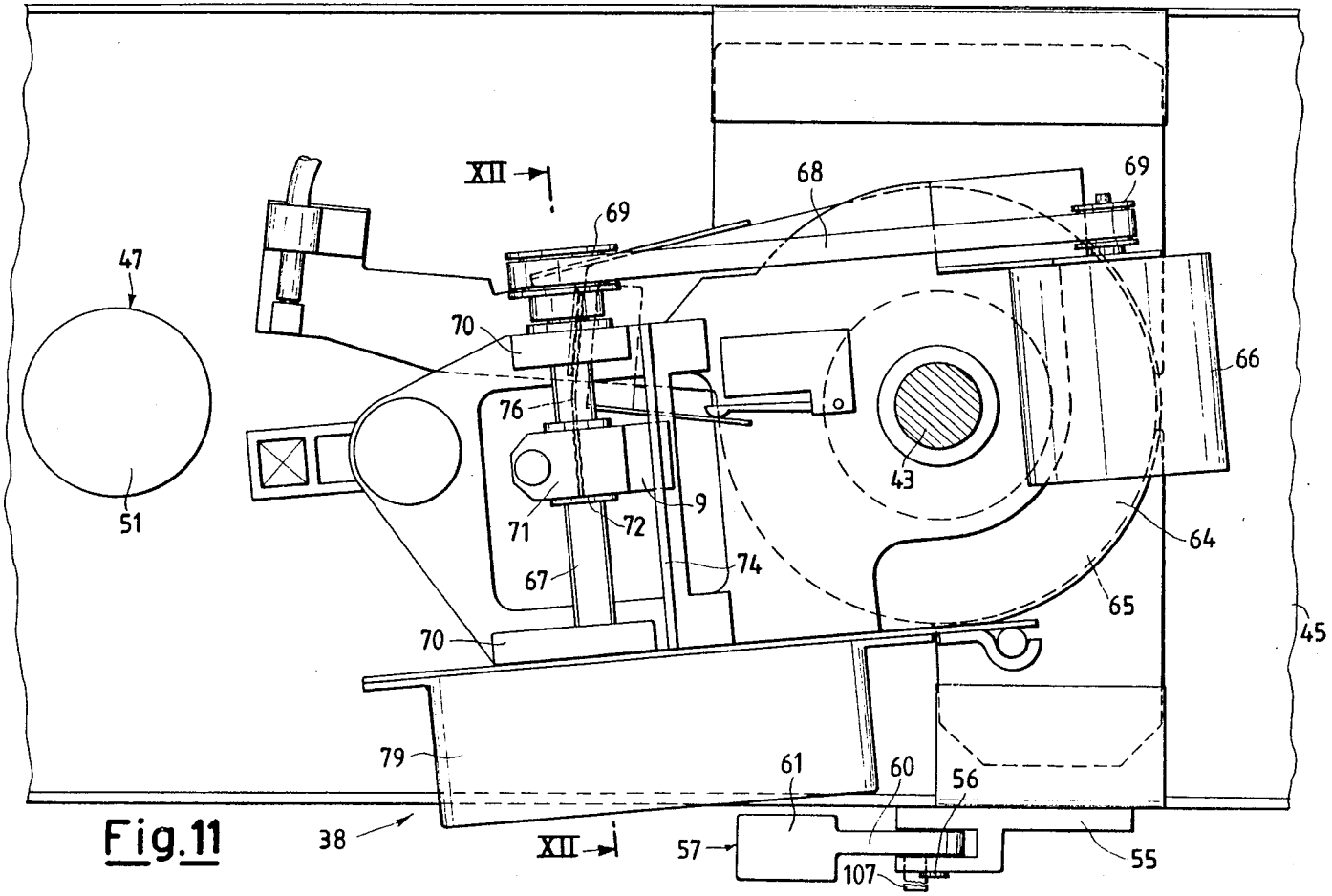
FIG. 11 is a partial plan view of the machine of FIG. 9
Figure 12:
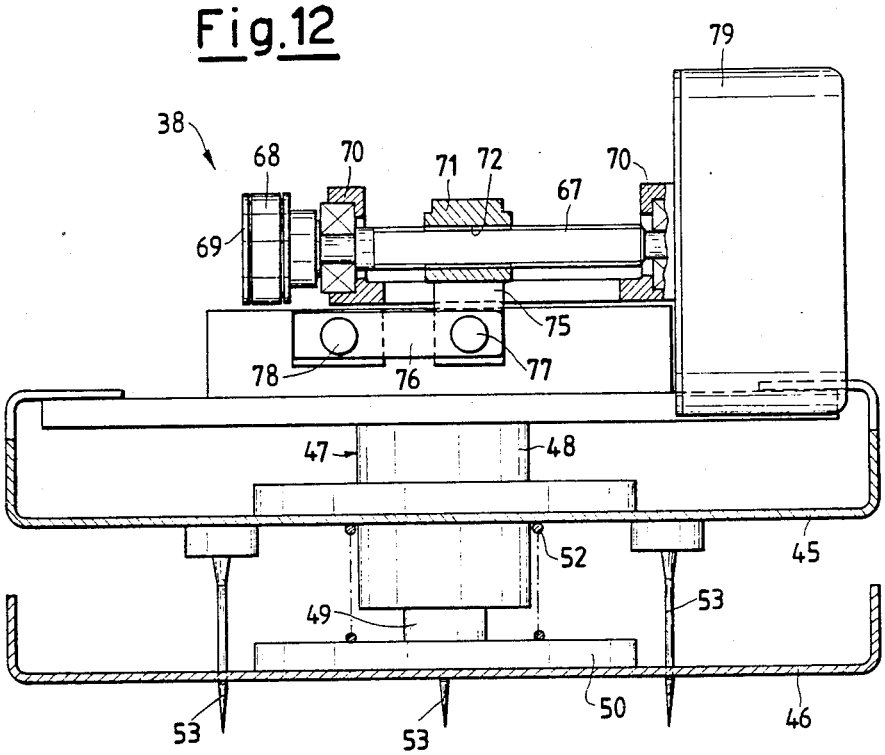
FIG. 12 is a sectional view taken along the lines XII—XII of FIG. 11 of the machine of FIG. 9

Before the assembling device 38 is lowered for assembling the first fabric layer 20, it is in the configuration of FIG. 5, in which the two plates 45 and 46 are elastically biased apart by the springs 52 in a position in which the needles 53 are completely inside the space delimited by the plate 46 and in which the tooth 59 of the hook 57 is kept by the counterweight 61 against a wall 106 of the element 62. After the lower plate 46 enters into contact with the support plane 32 and with the first fabric layer 20, a further descent of the assembling device 38 causes the approach of the plate 45 to the plate 46 against the action of the spring 52 and, as a consequence, the partial extension of the needles 53 from the corresponding holes 54. The extended needles transfix the fabric layer 20 and partially enter into the support plane 32, as shown in FIG. 10. Subsequently the electronic command and control unit raises the assembling device 38 via the shaft 43. During the raising of the assembling device, the spring 52 is prevented from separating the two plates 45 and 46; by the tooth 59 of the hook 57 being seated in the cavity 63 of the element 62, that is the hook 57 clasps the element 62 fastening the two plates 45 and 46 in a fixed position in which the needles extend beyond the corresponding holes 54 thereby keeping the fabric layer 20 transfixed, as shown in FIG. 6. In the following phase, the assembling device 38 is carried over the correct position above the central fabric layer 20 and is lowered and raised so that the needles 53 transfix and carry with them the second fabric layer. The hook 57 is again kept by the counterweight 61 in locked position so as to keep always the needles in a jutting out position.

The following phase is the same for the third superior fabric layer 20. The three fabric layer 20 are transfixed by the needles 53 and laid one upon the other.

The support plane 32 provides a fibrous superior thickness 110, shown only in FIG. 10, which permits a partial penetration of the needles 53 into the plane during the assembling of the fabric layers 20 without creating friction forces which could obstruct the raising of the assembling device 38. At this point the driving unit 12, always on command of the command and control electronic unit 13 moves the assembling device 38, with the three overlapped fabric layers 20 transfixed by the needles 53, to the support base 87 of the sewing unit 14 in the position illustrated in FIG. 4 in correspondence with the stop elements 96 and 100, and then lowers such assembling member until it is in strict proximity of the base 87 itself. Even in this case, obviously, all the possibilities of movement and regulation, above seen and offered by the driving unit, 12 are utilized. When the assembling device is in the cited correct position, the pneumatic actuator 95 of the small hammer 93 is controlled so that the hammer strikes against a projection 107 of the arm 58 of the hook, unlocking the hook from the element 62. This permits spring 52 to separate, as far as possible, the plate 46 from the plate 45 so that the lower plate slips the three overlapped fabric layers 20 from the needles and pushes them toward the base 87 where such fabric layers come to rest, as shown in FIG. 7. In this figure the unlockiing movement of the hook 57 operated by the small hammer 93 is schematized with an arrow H. The assembling device returns to this way in the position of FIG. 5.

At this point the pneumatic actuators of the two stop elements 96 and 100 are activated to cause the rotation of the two stop elements in a counterclockwise direction in FIG. 8 until an end such as 108 of said stop elements comes to a locked position against the three overlapped fabric layers 20 maintaining them firmly in position on the base 87, as shown in FIG. 8 in which only stop element 96 is shown and its corresponding extremity 108 which locks the cited fabric layers. Base 87 is then commanded to move along the guide rods 90 toward the clamping group, composed of the three pliers 101, 102, 103 until the portion of the base 87 on which there are the three overlapped fabric layers 20 is situated within the pliers. The pliers are closed so as to clamp firmly the three overlapped fabric layers 20 and the stop elements 90 are rotated by the corresponding pneumatic actuators in a direction opposite to the preceding one in such a way as to release the three overlapped fabric layers. The base 87 is withdrawn and the three overlapped fabric layers 20 remain among the pliers 101, 102, 103. The real sewing operation of the three overlapped fabric layers 20 then takes place, which is executed by the sewing head 105 of the sewing apparatus 104, which sews together the three fabric layers 20 along an outline defined by the edges 101 A, 102 A, 103 A of the three pliers 101, 102, 103. During the steady operation of the machine, when the holdfasts of the pliers 101, 102, 103 are holding the three overlapped fabric layers 20 on the portion of the base 87, the previously sewn together fabric layers 20 are layed on the lower holdfasts of the three pliers and thus are carried by the same holdfasts against the lower surface of the said portion of the base 87. The stop elements 96 and 100 are then rotated in the clockwise direction, with reference to FIG. 8, in such a way to release the overlapped fabric layer 20, to be sewn, from being fixed to the base 87 and 108 locks already sewn together fabric layers 20 against the lower surface of the portion of the base 87. In FIG. 8 the counter-end 109 of the stop element 96 may be seen. The overlapped fabric layers 20 yet to be sewn remain together in the clamping group, while those already sewn are dragged away from the base 87 and released, fall into an assembling area of the sewing unit 14, the stop element 96 and 100 drive counterclockwise (see FIG. 8) to lock onto the base 87 a new set of three overlapped fabric layers 20. The above description is an operative cycle of the machine 10. The machine procedes uninterruptedly to draw fabric layers from the fabric pile loaded on the stripping unit 11, to load them on the support plane 32, to carry them under the television camera, to assemble and overlap them by means of the assembling member 38, to discharge them overlapped on the base 87 of the sewing unit 14, to carry them to the clamping group and to sew them by the sewing apparatus 104. The logic control unit 18 is connected to the stripping unit 11, to the electronic elaborator 17, to the command and control unit 13 and to the sewing unit 14 for managing and co-ordinating all the above cited operations.

A machine is therefore realized which, starting from a pile of fabric layers, automatically draws them, accurately overlaps them and dews them.

The automatic drawing and the overlapping of the fabric layers represent obviously a considerable advantage, permitting avoidance of the onerous activity of the operator, considered in the introductory part of the description, with regards to time, costs and fatigue.

It is however to be remarked that such a machine is extremely flexible. With such a machine it is possible to overlap and sew together fabric layers of various numbers, shapes, sizes and characteristics for different requirements in the manufacturing industry. For example it is possible to form, instead of collars, shirt cuffs starting from three fabric layers of substantially rectangular shape. It is possible to form garment pockets by overlapping and sewing together, instead of three, simply two fabric layers each with the appropriate shape, size and characteristic.

As a demonstration of the flexibility of the machine 10, slide 92 of the sewing unit 14 is movable along the aperture 91 in such a way as to place the stop element 100 according to the length of the overlapped fabric layers so that the two step elements 96 and 100 may always act on symmetrical points of the overlapped fabric layers. The clamping group is kinematically connected to the slide 92 in such a way that the pliers 101, 102, 103 go a way or approach each other as a function of the length of the overlapped fabric layers. The logic control unit 18 may be informed by the television camera 15, through the electronic elaborator 17, about the variation of the fabric layer length and consequently, may control the displacement of the slide and the relative displacement of the pliers.

It is clear that variations and modifications as to what has been described and illustrated may be provided. As far as the stripping unit is concerned, it is possible to vary the number the form and the sizes of the trays according to the needs. The hold members, which will vary functionally based on the number of the trays, may be replaced with other types of hold members, for example with hold heads comprising adhesive rollers to each of which adheres the fabric layer, or with hold head formed by pick-up pliers. Instead of carrying the support plane of the fabric layers forward the hold members for carrying them under the television camera with the fabric layers layered thereon, it is possible to carry the hold members with the fabric layers attached thereon to the support plane fixed under the television camera and releasing them on the same plane. It is possible to have only a hold member which discharges one by one the fabric layers of the support plane drawing them from a pile. The television camera may be replaced by any means which transforms the visual image into electrical signals which may be elaborated by an electronic elaborator for determining the position of the fabric layers on the support plane. Even the methods and the algorithms for the determination of the position itself may be varied.

As far as the driving unit is concerned it is possible to provide that the arm carrying the assembling device has different movement with respect to those already considered. For example instead of rotating around an axis and translating along another axis, perpendicular to the previous one, it may translate along two perpendicular axes. The driving unit may comprise a fixed structure along which moves the assembling device for assembling the fabric layers form the stripping unit and discharging them on the sewing unit. The assembling device may itself present variations for example as regards the configuration of the plates, according to the fabric layer form and to the type of the connecting members. As far as the rotation of the assembling device is concerned, it would be effected by rotating directly the shaft 43 fixed to the assembling device itself; that is to say mounting a small electric motor and the corresponding kinematic elements on the assembling device for causing its rotation relative to the shaft. The results are particularly effective to releave as much as possible the load support by the end of the arm of the driving unit. For this purpose it is also very effective to drive the shaft through a remote controlled cable. Clearly, the kinematic elements above described and illustrated which permit the electric motor to rotate the assembling device as regards the shaft, may be replaced by kinematic elements having equivalent function if they are particularly advantageous because they do not require an electric motor of relatively greater power, and thus heavy, for rotating the assembling device, due to the great reduction effected by the screw 67 and because, always due to this reduction, they permit a fine regulation of the rotation of the assembling device. The unlocking means of the two plates of the assembling device may be of the electromagnetic type, that is, instead of the small hammer 93 of the sewing unit 14 it is possible to use an electromagnetic operator, mounted on the assembling device and schematically indicated by 8 in dotted lines in FIG. 10, which moves the hook, keeping the two plate unit, in the unlocked position when the assembling device is on the sewing unit in the position of discharging the three overlapped fabric layers. Generally the unlocking means of the two plates may be of any type mounted either on the assembling device or on the sewing unit. Instead of the counterweight 61, it is possible to use a spring schematically, indicated in FIG. 10 in dotted lines by 7, to keep the hook against the corresponding element with which it locks. With reference to the sewing unit, as has been said, the use of the small hammer is not essential. Moreover it is possible to provide that the clamping group moves relatively to the sewing apparatus instead of to the contrary, or that the sewing apparatus and the clamping group move together and relatively between themselves. Generally the machine may have a configuration more integrated than the one illustrated in that instead of being formed by physically separated structures, it may be formed by a single, more compact structure. Finally the machine, even though it particularly provides for the application to fabric layers, may be employed for working layers of other material which however may be manipulated and sewn in a similar way.

We claim:

1. Machine for supplying unsewn overlapping fabric layers to a sewing unit having a clamping group for sewing comprising:

a stripping unit providing holding means for the fabric layers and a supporting plane upon to which the holding means release said fabric layers in a position separated one from another;

mounted means in correspondence to said supporting plane to transform a visual image of said supporting plane and of the fabric layers, layed thereon, into electrical signals;

electronic elaborating means connected to said mounted means transforming the visual image into electrical signals for the determination of the position of the fabric layers on said supporting plane; and a driving unit connected to said electronic elaborating means, comprising an assembling device movable along said supporting plane between said supporting plane and said sewing unit, said driving unit as a result of the data supplied by said electronic elaborating means, moving said assembling device along said supporting plane for assembling one by one in an overlapping manner said fabric layers from said support plane and to said sewing unit for discharging the fabric layers onto the sewing unit.

2. The sewing machine according to claim 1 wherein said stripping unit includes a plurality of trays on each of which rest a pile of fabric layes and holding means comprising a plurality of holding members each of which is placed in correspondence with a respective tray and is movable between a holding position of a single fabric layer and a removed discharge position of the fabric layer on said supporting plane.

3. The machine according to claim 2 including a common rotational shaft, said holding members being rotatably mounted on said common rotational shaft for rotation between the holding position and the discharge position of the fabric layers.

4. The machine according to claim 2 wherein said supporting plane is movable between a loading position of the fabric layers in correspondence with said holding members when they are in the discharge position of the fabric layer and an individualization and drawing position of the fabric layers in correspondence with said mounted means which transform the visual image into electric signals.

5. The machine according to claim 4 including rectilinear guides upon which said supporting plane is mounted for moving said supporting plane in rectilinear motion between said discharge position and said individualization and drawing position.

6. The machine according to claim 1 wherein said mounted means for transforming the visual image into electric signals is a television camera.

7. The machine according to claim 6 wherein said television camera is of the matrix type.

8. The machine according to claim 6 including a monitor to which the television camera is connected.

9. The machine according to claim 1 wherein said electronic elaboration means comprises a monitor and a keyboard.

10. The machine according to claim 1 wherein said driving unit comprises a movable arm carrying said assembling device.

11. The machine according to claim 10 wherein said arm is rotatable around a rotational axis and may rectilinearly translate along a translational axis perpendicular to said rotational axis.

12. The machine according to claim 11 wherein said arm is composed by two semi-arms parallelly movable one with respect to the other during the rotation of the arm, said semi-arms, in their relative movement, rotating said assembling device.

13. The machine according to claim 1 wherein said driving unit comprises operating means for moving said assembling device between a raised position, an assembling position and a discharge position.

14. The machine according to claim 13 including anchorage means wherein said assembling device is connected to said operating means of the assembling device through said anchorage means.

15. The machine according to claim 1 wherein said assembling device has an axis about which it rotates.

16. The machine according to claim 1, wherein said assembling device comprises first and second principal elements connected in such a way that each may freely move reciprocally between a separatory position and an approached position, said first principal element carrying solidly a plurality of needles and the second principal element having a plurality of holes in correspondence with said needles, in the separatory position said needles being gathered in a space included between said first principal elements, in the approached position said needles extending through and beyond said holes, locking means mounted on said first and second principal elements which lock said first and second principal elements in said approached position, said needles during the passage from said separatory position to said approached position extending gradually beyond said holes to transfix said fabric layers, said needles withdrawing into said holes during the passage from said approached position to said separatory position to slip off the fabric layers from said needles.

17. The machine according to claim 16 wherein said first and second principal elements having interposed therebetween elastic members which elastically bias said first and second principal elements to said separatory position.

18. The machine according to claim 16 including a stem-bushing connection connecting said first and second principal elements to permit reciprocal mobility between said first and second principal elements.

19. The machine according to claim 16 wherein said first and second principal elements are parallel to each other and move reciprocally while maintaining said parallelism.

20. The machine according to claim 16 wherein said locking means comprise a hook connected to one of said first and second principal elements and a block element connected to the other of said first and second principal elements, said hook being in an unlocked position when said first and second principal elements are in a separatoreal reciprocal position and in a locked position when said first and second principal elements are in a reciprocal approached position.

21. The machine according to claim 20 including means on said hook which assist said hook to lock to said block element when said first and second principal elements are in the reciprocal approached position.

22. The machine according to claim 1 wherein said means which assist said hook comprise a counterweight.

23. The machine according to claim 21 wherein said means assisting said hook comprise an elastic member.

24. The machine according to claim 20 wherein said hook is povitable.

25. The machine according to claim 16 including anchorage means interconnecting said assembling device and said driving unit, said assembling device being rotatable with respect to said anchorage means.

26. The machine according to claim 25 including motor means and kinematic elements, said motor means being fixed to said anchorage means and connected to said first and second principal elements of the assembling device through said kinematic elements to permit the rotation of the assembling device with respect to said anchorage means.

27. The machine according to claim 26 wherein said kinematic elements comprise a screw mounted on said anchorage means for rotating thereon and rotatably connected to said motor means, a block screw-coupled to said screw to rectilinearly translate the rotation of the screw and a flexible element, said block being connected, through said flexible element to none of the first and second principal elements of the assembling device.

28. The machine according to claim 27 including an angular position sensor mounted on said anchorage means and rotatably connected to said screw.

29. The machine according to claim 26 wherein said anchorage means comprise a foot of a shaft driven by said driving unit.

30. The machine according to claim 29 wherein said shaft has a longitudinal axis and is driven by said driving unit along said longitudinal axis.

31. The machine according to claim 1 including a clamping group and wherein said sewing unit comprises a support base on which said assembling device discharges the overlapped fabric layers, said support base being movable between a receiving position of said overlapped fabric layers and a coupling position with said clamping group for the withdrawal, by the clamping group, of the overlapped fabric layers.

32. The machine according to claim 16 including a clamping group and unlocking means and wherein said sewing unit comprises a support base on which said assembling device discharges the overlapped fabric layers, said support base being movable between a receiving position of said overlapped fabric layers and a coupling position with said clamping group for the withdrawal by the clamping group of the overlapped fabric layers, said unlocking means for said locking means on said principal elements of the assembling device being mounted on said sewing unit.

33. The machine according to claim 33 wherein said unlocking means are mounted on said support base of the sewing unit.

34. The machine according to claim 32 wherein said unlocking means comprise a small hammer driven against said locking means for causing its unlocking.

35. The machine according to claim 31 including two stop elements on said support base to block the overlapped fabric layers on said support base, said stop elements being movable between a locking position and unlocking position for said overlapped fabric layers.

36. The machine according to claim 35 wherein said stop elements are substantially semi-ring shaped and are rotable between two positions.

37. The machine according to claim 35 wherein said two stop elements, in said unlocking position of the overlapped fabric layers, clamp overlapped fabric layers already sewn carried by said clamping group against the lower surface of said support base of the sewing unit.

38. The machine according to claim 35 wherein one of said stop elements is movably mounted on said support base with respect to the other and is kinematically connected to said clamping group for determining an extension or shortening of the clamping group as a function of its displacement as regards to the other stop element.

39. The machine according to claim 1 including a control logic unit for the management and the coordination of the machine, said control logic unit being connected to the stripping unit, to the electronic elaboration means, to the driving unit and to the sewing unit.

40. The machine according to claim 1 wherein said electronic elaboration means computerize the center and the angle-shot, with respect to reference axes, of each of the fabric layers resting on the support plane of the stripping unit for the determination of the position of the fabric layers on the support plane.

41. The machine according to claim 16 wherein said support plane comprises an upper fibrous thickness for receiving said needles.

42. The machine according to claim 16 wherein each of said first and second principal elements of the assembling device is formed by a plate.

43. The machine according to claim 16 wherein said assembling device comprises unlocking means for said locking means.

* * * * *